US006204228B1

(12) United States Patent
MacNeil et al.

(10) Patent No.: US 6,204,228 B1
(45) Date of Patent: Mar. 20, 2001

(54) LIGHT-COLORED SULFUR-CONTAINING EXTREME PRESSURE LUBRICANT ADDITIVES

(75) Inventors: James G. MacNeil, New Philadelphia; Barbara A. Wade, Dalton; C. Joseph Fette, New Philadelphia, all of OH (US)

(73) Assignee: Dover Chemical Corp., Dover, OH (US)

( * ) Notice: Subject to any disclaimer, the term of this patent is extended or adjusted under 35 U.S.C. 154(b) by 0 days.

(21) Appl. No.: 09/238,305

(22) Filed: Jan. 28, 1999

(51) Int. Cl.[7] ..... C10M 133/00; C10M 135/00
(52) U.S. Cl. ..... 508/548; 508/388
(58) Field of Search ..... 508/388, 548

(56) References Cited

U.S. PATENT DOCUMENTS 3,336,382 * 8/1967 Pearson ..... 260/556
3,577,459 5/1971 Laughlin .
5,453,210 9/1995 Bardasz et al. .
5,484,542 1/1996 Cahoon et al. .
5,523,005 6/1996 Di Biase et al. .

* cited by examiner

*Primary Examiner*—Margaret Medley
*Assistant Examiner*—Cephia D. Toomer
(74) *Attorney, Agent, or Firm*—Oldham & Oldham Co., LPA

(57) ABSTRACT

Extreme pressure lubricants, concentrates and greases. Disclosed herein are extreme pressure metal working lubricants which comprise a lubricant base material and a reaction product of (1) an amine containing from 1 to about 30 carbon atoms and (2) sulfamic acid or derivative thereof containing from 1 to about 30 carbon atoms. The reaction product or extreme pressure additive may be either water soluble or oil soluble. Amines containing from 1 to about 7 carbon atoms are generally used for making water soluble reaction products, and amines containing 8 or more (up to about 30) carbon atoms are generally used for making oil soluble reaction products. Water based lubricants comprise water and a water soluble reaction product. Oil based lubricants comprise an oil of lubricating viscosity and an oil soluble reaction product. Reaction products may be either addition products or sulfonamides.

20 Claims, No Drawings

LIGHT-COLORED SULFUR-CONTAINING EXTREME PRESSURE LUBRICANT ADDITIVES

TECHNICAL FIELD

The invention described herein pertains generally to oil- and aqueous-based compositions and to the improvement of the appearance, safety and stability of such fluids.

BACKGROUND OF THE INVENTION

Modern metal working and forming processes normally require the use of cutting fluids whose function is to facilitate the machining operations by cooling and lubricating. The cooling function is accomplished by the ability of the fluid to carry off the heat generated by the frictional contact between the tool and the work piece and/or any heat resulting from the plastic deformation of the work. Cooling aids tool life, preserves tool hardness and helps to maintain the dimensions of the machined parts. The second function is accomplished by the ability of the fluid to lubricate the tool work piece interface in order to reduce tool wear, frictional heat generation and power consumption. The presence of a fluid also serves to carry away debris from the work area.

In addition to the primary functions of cooling and lubricating, cutting fluids should protect the machined surfaces, tools and other equipment from rust and corrosion, should not themselves corrode, discolor or form deposits in or on the work area, and should not produce undesirable flames or smoke. Additionally, in those instances where skin contact is unavoidable, the cutting fluid compositions should be non-toxic and dermatologically safe.

Moreover, the cutting fluid composition itself should, ideally have some stability against microorganisms. Bacteria and fungi frequently spoil soluble cutting fluids (especially oil and water emulsions) during machining operations. Not surprisingly, the cutting environment, which contains warm water and an available carbon source, provides a good medium for microorganism growth. Spoilage often manifests itself first as a foul smell. This can also be caused by the presence of sulfur-containing additives that are capable of being reduced to hydrogen sulfide, which smells like rotten eggs.

Sulfur-containing additives have been made from treatment of olefins or fats with elemental sulfur. The resulting products are black in color and smell of hydrogen sulfide. Additionally, free thiol functionalities will react with many metals, especially those containing copper, and stain the metal black. Alternative products are polysulfides, which can be light in color but tend to decompose into elemental sulfur and mercaptans upon standing. The polysulfides and the sulfurized fats and olefins are only soluble in oil.

Sulfur-containing additives become functional under conditions of extreme heat and pressure, producing metal sulfides which can improve metal cutting and forming efficiency. Metalworking fluids that incorporate sulfur-containing additives can improve the efficiency of various metalworking operations.

SUMMARY OF THE INVENTION

Compositions according to this invention include lubricants, concentrates and greases. All of these compositions comprise a lubricant base material and an extreme pressure additive.

The additives of this invention are reaction products of sulfamic acid or derivative thereof with an amine. The amine functionality includes aromatic amines, alkanolamines, $C_{1-30}$alkyl amines, or other amine derivatives. These amines may be primary, secondary, or tertiary. Also included are diamines, triamines, or other polyamines. The sulfamic acid or derivative thereof (which may be referred to as the "sulfamic acid compound" or "the sulfamic acid reactant") is preferably sulfamic acid itself but may be a derivative containing from 1 to about 30 carbon atoms.

Additives of this invention contain from 1 to about 36 carbon atoms, preferably from 2 to about 30 carbon atoms. These additives may be either water soluble or oil soluble. In general, water soluble additives contain from 1 to about 7 carbon atoms, and oil soluble additives contain from about 8 to about 36 carbon atoms.

The additives of this invention are stable. They do not decompose under normal lubricant service conditions. The sulfur in these additives is inactive. This means that the sulfur will not react with metal until extreme conditions are met. Additives of this invention will not attack metals such as copper brass and bronze at temperatures below 200° F. (95° C.) and will not corrode or stain steel upon use. This represents a major advantage of additives of this invention compared to sulfur-containing lubricant additives known in this art.

The lubricant base material may be either water or an oil of lubricating viscosity, depending on whether a water based lubricant or a oil based lubricant is desired.

DETAILED DESCRIPTION OF THE INVENTION

The best mode for carrying out the invention will now be described for the purposes of illustrating the best mode known to the applicant at the time. The examples are illustrative only and not meant to limit the invention.

The extreme pressure additive for compositions of this invention is a reaction product of an amine with sulfamic acid.

The amine starting material contains from one to about 30 carbon atoms. This amine may be either primary, secondary or tertiary. Also, it may be either aliphatic, alicyclic or aromatic. The amine may be a hydrocarbon amine, such as ethylamine, in which the entire molecule other than the amino group or groups contains only carbon and hydrogen. Alternatively, the amine may contain other groups, such as for example hydroxy, mercapto, nitroso, nitro and sulfoxy. In particular, hydroxy-substituted amines, as for example ethanolamine (also known as monoethanolamine, MEA), are of interest as starting materials.

When an oil soluble reaction product is desired, the amine starting material will typically contain from eight to about 30 carbon atoms. Similarly, when a water soluble reaction product is desired, the starting amine will typically contain from one to about seven carbon atoms. However, whether the reaction product is water soluble or oil soluble depends not only on the carbon chain length of the starting amine, but also to some extent on the presence of hydrophilic groups, and particular, hydroxy.

In this application, the term "hydrocarbyl" will be used, and for the purposes of definition, will include hydrocarbon, as well as substantially hydrocarbon groups. Substantially hydrocarbon describes groups which contain hetero atom substituents which do not alter the predominantly hydrocarbon nature of the group. Examples of hydrocarbyl groups include the following: (1) hydrocarbon substituents, this is aliphatic (e.g., alkyl or alkenyl), alicyclic (e.g., cycloalkyl, cycloalkenyl) substituents, aromatic-substituted aliphatic substituents or aromatic-substituted alicyclic substituents, or aliphatic- and alicyclic-substituted aromatic substituents and the like, as well as cyclic substituents wherein the ring is completed through another portion of the molecule (that is, for example, any two indicated substituents may together form an alicyclic radical); (2) substituted hydrocarbon substituents, that is, those substituents containing non-hydrocarbon groups which, in the context of this invention, do not alter the predominantly hydrocarbon nature of the substituent; those skilled in the art will be aware of such groups (e.g., hydroxy, mercapto, nitroso, nitro, sulfoxy, etc.); and (3) hetero atom substituents, this is, substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those skilled in the art and include, for example, sulfur, oxygen, nitrogen and such substituents as, e.g., pyridyl, furyl, thienyl, imidazolyl, etc. In general, no more than one hetero atom substituent will be present for every ten carbon atoms in the hydrocarbyl group. Typically, there will be no such heteroatom substituents in the hydrocarbyl group, and in a preferred embodiment, the hydrocarbyl group will be purely hydrocarbon.

The amine starting material may be either a monoamine, a diamine, a triamine, or higher polyamine. Generally the starting material may contain from 1 to about 6 amino or substituted amino groups. Preferred starting amines are those containing 1 to about 3 amino or substituted amino groups. The term, "polyamine", as used herein includes diamines and triamines as well as amines containing more than three amino or substituted amino groups. Monoamines are particularly preferred amine starting materials.

Amine starting materials used in this invention may be represented by the formula (I) below:

$$R^1(NR^2R^3)_n \quad (I)$$

wherein:

$R^1$ is a hydrocarbyl group having the valence n;

$R^2$ and $R^3$ are independently selected from the group consisting of hydrogen and a monovalent hydrocarbyl group; and n is a small positive integer, i.e., from 1 to about 6.

The total number of carbon atoms in the reaction product may be from 1 to about 36 and preferably is from 2 to about 30.

Preferably:

$R^1$ is alkyl, hydroxyalkyl, cycloalkyl or aryl;

$R^2$ is hydrogen, alkyl, hydroxyalkyl, cycloalkyl or aryl;

$R^3$ is hydrogen, and n is from 1 to 3.

More preferably:

$R^1$, $R^3$, are as above defined; $R^2$ is hydrogen; and n=1.

Ethanolamine is a preferred starting material when a water soluble reaction product is desired.

When an oil soluble reaction product is desired, a preferred class of amine starting materials are tertiary alkyl primary amines containing from about 10 to about 24 carbon atoms, preferably from about 12 to about 22 carbon atoms. Representative amines of this type are "Primene" 81-R and "Primene" JM-T, both made by Rohm and Haas Company, Philadelphia, Pa., USA. Both of these products are primary aliphatic amines with highly branched alkyl chains in which the amino nitrogen atom is linked to a tertiary carbon atom. These amines include mixtures of isomeric amines, Primene 81-R in the $C_{12-14}$ range and Primene JM-T in the $C_{16-22}$ range.

Table 1 lists typical physical properties of these amines.

TABLE 1

Typical Physical Properties

| Property | Primene 81-R | | Primene JM-T |
|---|---|---|---|
| CAS Register Number | 68955-53-3 | | 68955-54-4 |
| Specific Gravity, 25° C. (77° F.) | 0.813 | | 0.834 |
| Density, lbs./gal. @ 25° C. (77° F.) | 6.77 | | 6.95 |
| Flash Point, ° C. | 82[b] | | 100[b] |
| Ash Content, percent | None | | <0.1 |
| Boiling Range @ 760 mm, ° C. (° F.) | 223–240 (433–464) | | 265–305 (509–581) |
| | (5–90%) | | (5–70%) |
| Color, APHA or FCS[a] | 10 (APHA) | | 4 (VCS) |
| Pour Point, ° C. | Below −60 | | Below −40 |
| Solubility, in water | None | | None |
| Solubility, in petroleum stocks | Excellent | | Excellent |
| Solubility, in organic solvents | Excellent | | Excellent |
| Viscosity | cSt. | SUS | cSt. |
| @ 100° C. (212° F.) | 0.96 | — | 2.3 |
| 38° C. (100° F.) | 2.50 | 34.4 | 9.5 |
| −18° C. (0° F.) | 18.2 | 90 | 120 |
| −40° C. (−40° F.) | 109 | 500 | |

[a]May darken on prolonged standing but with no loss of effectiveness
[b]Pennsky-Martens Closed Tester Sulfamic acid or derivative thereof is the other starting material. The sulfamic acid or derivative thereof (i.e., the sulfamic acid reactant or sulfamic acid compound) is a compound of the formula (II):

$$HOSO_2NR^4R^5 \quad (II)$$

wherein $R^4$ and $R^5$ are independently selected from the group consisting of hydrogen and a hydrocarbyl group.

Preferred derivatives of sulfamic acid are compounds in which the hydrocarbyl group is (are) hydrocarbon hydrocarbyl and the total number of carbon atoms is from 2 to about 12. However, sulfamic acid itself ($R^4$=$R^5$=H) is preferred.

Reaction of the starting amine with sulfamic acid is carried out in a liquid reaction medium. The starting amines for the most part (excluding those of higher molecular weight) are liquids at the desired reaction temperature, and in this case, the reaction may be carried out "neat" or in bulk, using the starting amine as the reaction medium. Alternatively, and in all cases when the starting amine is a solid, the reaction will be carried out in an organic solvent medium. Suitable solvents include, for example, ethanol, other lower monohydric alcohols, ethylene glycol, and mineral spirits. The solvent (when one is used) should not react with either sulfamic acid or the starting amine under the reaction conditions used for reacting the amine with sulfamic acid.

Stoichiometric quantities of the starting amine and sulfamic acid react quantitative to produce the desired reaction product. The preferred reaction products are addition products, and in particular, are sulfamic acid salts of the respective starting amines. The preferred reaction products are liquids at room temperature (25° C.), although in some cases a solid reaction product may be desirable.

The reaction product may be either an addition product or a substitution product, i.e., a sulfonamide. Both will be described in greater detail below. Formation of an addition product is favored when the reaction temperature is from room temperature (20° C.) up to about 100° C. A preferred temperature range for obtaining an addition product is from about 80° to about 95° C. (i.e., about 200° F., range limits have been rounded since the limit is not sharply defined). Formation of a substitution product, i.e., a sulfonamide is favored at reaction temperatures from about 100° C. to about 200° C. (i.e., about 400° F.).

The preferred reaction products are addition products, and specifically, sulfamic acid salts of amines, which may be represented by the general formula (III) below:

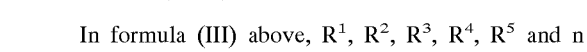

$$R^1(NR^2R^3)_n.nHOSO_2NR^4R^5 \quad (III)$$

In formula (III) above, $R^1$, $R^2$, $R^3$, $R^4$, $R^5$ and n are as previously defined.

Reaction products of the formula (III) may be prepared by reaction of a starting amine of the formula (I) with a sulfamic acid compound of the formula (II) according to equation (1) below.

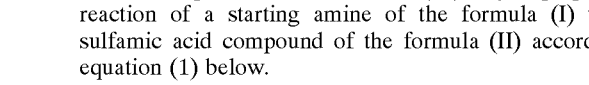

$$R^1(NR^2R^3)_n+nHOSO_2NR^4R^5 \rightarrow R^1(NR^2R^3)_n.nHOSO_2NR^4R^5 \quad (Eq.1)$$

Sulfonamides of amines are also suitable reaction products in accordance with this invention. These are substitution products and may be either water soluble or oil soluble.

Sulfonamide additives according to the present invention may be represented by the following formula (IV):

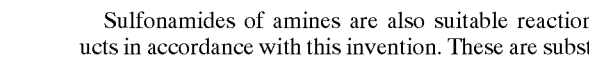

$$R^1(R^2NSO_2NR^4R^5)_n \quad (IV)$$

where $R^1$, $R^2$,$R^4$ and $R^5$ are as previously defined. Preferred values of $R^1$, $R^2$, $R^4$ and $R^5$ an also as stated previously.

Sulfonamides of the formula (IV) may be prepared by reacting a primary or secondary amine of the formula (I) above described (wherein $R^3$=H) with a sulfamic acid compound of the formula (II) above described. This reaction proceeds according to equation (2) below.

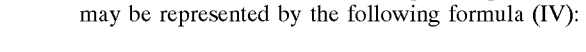

$$R^1(NR^2H)_n+nHOSO_2NR^4R^5 \rightarrow R^1(R^2NSO_2NR^4R^5)_n+nH_2O \quad (Eq. 2)$$

In equation (2) above $R^1$, $R^2$, $R^4$ $R^5$ and n, including preferred values thereof, are as previously defined. (Thus, n may be from 1 to about 6, preferably 1 to about 3, most preferably 1).

The above lubricant additives can be employed in a variety of lubricants based on diverse oils of lubricating viscosity, including natural and synthetic lubricating oils and mixtures thereof. The additives of the present invention can be used in lubricants or in concentrates. The concentrate contains the additives alone or in combination with other components used in preparing fully formulated lubricants. The concentrate may contain a substantially inert organic diluent, which includes kerosene, mineral distillates or one or more of the oils of lubricating viscosity. Concentrates may contain from 0.01%, or about 0.1%, or about 1% to about 70%, or about 80% or about 90% by weight of the compositions of the present invention. These composition may be present in a final product, blend or concentrate in any amount effective to act as an antiwear agent.

The oil which is used in the preparation of the lubricants of the invention may be based on natural oils, synthetic oils, or mixtures thereof. Natural oils include animal oils and vegetable oils (e.g., castor oil, lard oil) as well as mineral lubricating oils such as liquid petroleum oils and solvent treated or acid treated mineral lubricating oils of the paraffinic, naphthenic or mixed paraffinic-naphthenic types. Oils of lubricating viscosity derived from coal or shale are also useful. Synthetic lubricating oils include hydrocarbon oils and halo-substituted hydrocarbon oils such as polymerized and inter-polymerized olefins (e.g, polybutylenes, polypropylenes, propylene-isobutylene copolymers, chlorinated polybutylenes, poly(1-hexenes), poly(1-octenes), and mixtures thereof, alkylbenzenes (e.g., dodecylbenzenes, tetradecylbenzenes, dinonylbenzenes, di-(2-ethylhexyl) benzenes, etc.), polyphenyls (e.g, biphenyls, terphenyls, alkylated polyphenyls, etc.), alkylated diphenyl ethers and alkylated diphenyl sulfides and the derivatives, analogs and homologs thereof and the like.

Another suitable class of synthetic lubricating oils that can be used comprises the esters of dicarboxylic acids (e.g., phthalic acid, succinic acid, alkylsuccinic acids, alkenylsuccinic acids, maleic acid, azelaic acid, suberic acid, sebacic acid, fumaric acid, adipic acid, linoleic acid dimer, malonic acid, alkylmalonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(w-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$–$C_{22}$ monocarboxylic acids and polyols and polyol ethers such as neopentyl glycol, trimethylolpropane, pentaerythritol, dipentaerythritol, tripentaerythritol, etc.

Silicone based oils such as polyalkyl, polyaryl, polyalkoxyl or polyaryloxy-siloxane oils comprise another useful class of synthetic lubricants (e.g., tetraethylsilicate, tetraisopropylsilicate, tetra-(2-pentoxy)disiloxane, poly (methyl)siloxanes, poly(methylphenyl)siloxanes, etc.). Other lubricating oils include liquid esters of phosphorus-containing acids (e.g., tricresyl phosphate, trioctyl phosphate, diethyl ester of decanephosphonic acid, etc.), polymeric tetrahydrofurans and the like.

Unrefined, refined and re-refined oils, either natural or synthetic, as well as mixtures of two or more of any of these) of the type disclosed can be used in the concentrates of the present invention. Unrefined oils are those obtained directly from a natural or synthetic source without further purification treatment. For example, a shale obtained directly from retorting operations, a petroleum oil obtained directly from primary distillation or ester oil obtained directly from an esterification process and used without further treatment would be an unrefined oil. Refined oils are similar to unrefined oils except they have been further treated in one or more purification steps to improve one or more properties.

The oil of lubricating viscosity is generally present in a major amount (i.e., an amount greater than 50% by weight). Preferably, the oil of lubricating viscosity is present in an amount greater than about 60%, preferably 70%, more preferably 80% by weight. In a most preferred embodiment of this invention, the oil of lubricating viscosity is present in an amount greater than 90%, and in some instances, in an amount greater than 95%, in a final product or lubricant composition. Conversely the amine/sulfamic acid compound reaction product is present in an effective lubricating amount e.g., not over about 10% and typically not over, about 5% by weight.

In one preferred embodiment of the present invention, the composition is oil-based wherein the lubricant base material is an oil of lubricating viscosity. The amine/sulfamic acid compound reaction product is oil soluble and the amine reactant contains from about 8 to about 30 carbon atoms. In this embodiment, the amine reactant preferably is a tertiary alkyl primary amine of formula I where in $R^1$ is a tertiary alkyl radical containing from about 10 to about 24 carbon atoms. A nitrogen atom of the amine in Formula I is linked to a tertiary carbon atom; $R^2$, $R^3$, $R^4$ and $R^5$ are hydrogen and n=1.

Where the lubricant is to be used in the form of a grease, the lubricating oil generally is employed in an amount sufficient to provide the balance of the total grease composition and generally, the grease compositions will contain various quantities of thickening agents and other additive components to provide desirable properties. The amine/sulfamic acid compound reaction product is present in an effective lubricating amount, e.g., an amount of from about 0.5% to about 10% by weight, more preferably from 1% to about 10% by weight.

A wide varieties of thickeners can be used in the preparation of the greases of this invention. The thickeners are employed in an amount from about 0.5 to about 30%, more preferably from 3 to about 15% by weight of the total grease composition. Exemplary thickeners would include alkali and alkaline earth metal soaps of fatty acids and fatty materials having from about 12 to about 30 carbon atoms. The metals are typified by sodium, lithium, calcium and barium. Examples of fatty materials include stearic acid, hydroxystearic acid, stearin, oleic acid, palmitic acid, myristic acid, cottonseed oil acids and hydrogenated fish oils.

Other thickeners include salt and salt-soap combinations such as calcium stearate-acetate, barium stearate-acetate, calcium stearate-caprylate-acetate complexes, calcium salts and soaps of low, intermediate, and high molecular weight acids and of nut oil acids, aluminum stearate and aluminum complex thickeners. Additional examples would include clays, either naturally occurring, or chemically modified. These clays are crystalline complex silicates, the exact composition of which is not subject to precise description. In generally, they are complex inorganic silicates such as aluminum silicates, barium silicates and the like, containing, in addition to the silicate lattice, varying amounts of cation-exchangeable groups such as sodium. Hydrophilic clays which are particularly useful for conversion to the desired thickening agents include montmorillonite clays, such as bentonite, attapulgite, hectorite, illite, saponite, sepiolite, biotite, vermiculite, zeolite clays and the like.

This invention also includes aqueous compositions characterized by an aqueous phase with at least one reaction product dispersed or dissolved in the aqueous phase. Preferably, this aqueous phase is a continuous aqueous phase although, in some embodiments the aqueous phase can be a discontinuous phase. These aqueous compositions usually contain at least about 25% by weight water. Such aqueous composition encompass both lubricants containing from about 80% to about 97% by weight, preferably about 85% to about 95% by weight, and concentrates containing about 25% to about 80% by weight, preferably from about 40% to about 65% water. The amine/sulfamic acid compound reaction products are present in the aqueous compositions in an effective lubricating amount, which is generally an amount of from about 0.2% to about 10% by weight and optionally include conventional additives commonly employed in water-based functional fluids such as surfactants, thickeners, oil-soluble, water-insoluble functional additives such as dispersants, corrosion-inhibitors, shear stabilizing agents, bactericides, dyes, water-softeners, odor masking agents, antifoam agents, etc. The water-based functional fluids may be in the form of solutions, or micelle dispersions or microemulsions which appear to be true solutions.

In one embodiment of the present invention, the composition is water based, containing a lubricant base material that is water-soluble, the amine/sulfamic acid compound reaction product is water soluble, and the amine reactant of formula I contains from 1 to about 7 carbon atoms and $R^4$ and $R^5$ are hydrogen. More preferably in this embodiment, in the amine of formula I, $R^1$ is hydroxyalkyl and $R^2$, $R^3$ are hydrogen, and n=1.

Often the aqueous compositions of this invention contain at least one thickener, such as a polysaccharide, or a synthetic thickening polymer or mixtures thereof. Specific examples would include gums such as gum agar, guar gum, gum arabic, algin, dextrans, xanthan gum and the like. Also among the polysaccharides which are useful as thickeners are cellulose ethers and esters, including hydroxyhydrocarbylcellulose and hydrocarbylhydroxycellulose and salts thereof. Representative polymeric thickeners include polyacrylates, polyacrylamides, hydrolyzed vinyl esters, water-soluble homo and interpolymers of acrylamidoalkane sulfonates containing at least 50 mole percent of acrylamidoalkane sulfonate and other comonomers such as acrylonitrile, styrene or the like.

Products according to the present invention can be tested according to ASTM D-3233 and ASTM E-686 testing protocols, using a Falex pin-and-vee block tester. Test results are given in the examples below.

A Falex pin-and-vee block tester, was used as the measurement of lubricity (ASTM D-3233). A simple Falex EP (extreme pressure) load and friction test was used. A cleaned #8 steel pin and blocks were placed in the machine and the reservoir was filled with test fluid. After a one minute break-in period at a load of 250 lbs., the ratchet arm was engaged and the load was allowed to walk up to successively higher levels until failure occurred. Torque is a measurement of friction and boundary layer lubrication, with lower torque levels being desirable. The level of the failure load indicates EP performance of the metalworking fluid, with high levels being desirable. Failure occurs upon seizing, due to a lack of lubrication, with concurrent snapping of the pin.

The invention will be further described with reference to the examples below. These examples represent preferred embodiments of the invention, including the best mode and the preferred embodiment, and are given by way of illustration and not limitation.

EXAMPLE #1

388 g of sulfamic acid is added slowly to 244 g of monoethanolamine (MEA), maintaining the temperature below 200° F. An additional one hour of heating is followed by cooling to room temperature. 632 g of water-soluble product #1 are formed. Product 1 contains 20.25% sulfur by weight and at 5% in tap water carries a full load on the Falex pin-and-vee instrument (4500+ lbs.). By comparison, tap water is 250 lbs.

EXAMPLE #2

97 g of sulfamic acid is added slowly to 200 g of Amine 81-R (Rohm & Haas), which maintaining the temperature at 200° F. An additional one hour of heating is followed by cooling to room temperature 297 g of oil-soluble product #2 are formed. Product 2 contains 10 7% sulfur by weight, and at 5% in napthenic oil carries a full load on the Falex pin-and-vee instrument (4500+ lbs). By comparison napthenic oil is 1,250 lbs.

EXAMPLE #3

For comparative purposes, the following amounts of reactants were added, and resulted in an unacceptable product: 130 g diglycol amine ($HOCH_2CH_2OCH_2CH_2NH_2$) and 100 g sulfamic acid (solid product).

EXAMPLE #4

For comparative purposes, the following amounts of reactants were added, and resulted in an unacceptable product: 267 g oleyl amine and 97 g sulfamic acid (solid product).

EXAMPLE #5

For comparative purposes, the following amounts of reactants were added, and resulted in an acceptable product, but which would result in significant safety concerns. 105 g diethanol amine $(HOCH_2CH_2)_2NH$ and 97 g sulfamic acid.

EXAMPLE #6

For comparative purposes, the following amounts of reactants were added, and resulted in an acceptable, but expensive product. 284 g Amine JM-T ($C_{16-22}H_{33-45}NH_2$) and 97 g sulfamic acid (solid product).

EXAMPLE #7

For comparative purposes, the following amounts of reactants were added, and resulted in an unacceptable product 126 g Dytek A ($H_2N(cyclo\text{-}C_6H_{10})NH_2$) and 97 g sulfamic acid (solid product). (Dytek A is a product of E. I. duPont De Nemours & Co., Wilmington, Del. USA).

EXAMPLE #8

For comparative purposes, the following amounts of reactants were added, and resulted in an unacceptable product 306 g trioctyl amine ($(C_8H_{17})_3N$) and 230 g sulfamic acid (solid product).

EXAMPLE #9

For comparative purposes, the following amounts of reactants were added, and resulted in an unacceptable product 129 g n-octyl amine and 97 g sulfamic acid (solid product).

The extreme pressure additives used in making compositions of this invention contain chemically bound sulfur, typically from about 5% to 30% by weight. In most cases sulfamic acid is the sole source of sulfur in the additive, although some amines starting materials also contain sulfur. The sulfur in the additive is stable under conditions of use, so that lubricants according to the present invention will not decompose or blacken or give off any compounds having an undesirable odor under normal service conditions.

The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A composition comprising:

(a) a lubricant base material; and (b) a reaction product of (1) an amine of the formula (I)

$$R^1(NR^2R_3)_n \quad (I)$$

wherein:

$R^1$ is a hydrocarbyl group containing from 1 to about 30 carbon atoms and having the valence n;

$R^2$ and $R^3$ are independently selected from the group consisting of hydrogen and a monovalent hydrocarbyl group; and n is a small positive integer, from 1 to about 6;

and (2) a sulfamic compound, wherein said sulfamic compound is a compound of the formula (II)

$$HOSO_2NR^4R^5 \quad (II)$$

wherein:

$R^4$ and $R^5$ are independently selected from the group consisting of hydrogen and a monovalent hydrocarbyl group containing from 1 to about 30 carbon atoms, at least one of $R^4$ or $R^5$ being hydrogen; said reaction product being present in an effective lubricating amount.

2. A composition according to claim 1, wherein said composition is a lubricant and contains a major amount of said lubricant base material and a minor amount of said reaction product.

3. A composition according to claim 1, wherein said composition is a concentrate useful for preparing a lubricant.

4. A composition according to claim 1, wherein said composition is water based, said lubricant base material is water, and said reaction product is water soluble.

5. A composition according to claim 1, wherein said composition is oil based, said lubricant base material is an oil of lubricating viscosity, and said reaction product is oil soluble.

6. A composition according to claim 1 wherein:

$R^1$ is selected from the group consisting of alkyl, hydroxyalkyl, cycloalkyl, and aryl, $R^2$ is selected from the group consisting of hydrogen, alkyl, hydroxyalkyl, cycloalkyl and aryl;

$R^3$, $R^4$ and $R^5$ are hydrogen; and n is an integer from 1 to 3.

7. A composition according to claim 6, wherein, $R^2$ is in hydrogen; and n=1;

and the total number of carbon atoms in said reaction product is from 2 to 30.

8. A composition according to claim 1 wherein said reaction product is an addition product of said amine and said sulfamic compound.

9. A composition according to claim 8 wherein said addition product is a compound of the formula (III);

$$R^1(NR^2R^3)_n.nHOSO_2NR^4R^5 \quad (III)$$

and wherein $R^1$, $R^2$, $R^3$, $R^4$, $R^5$ and n are as previously defined.

10. A composition according to claim 1 wherein said reaction product is a sulfonamide.

11. A composition according to claim 10 wherein said sulfonamide is a compound of the formula (IV);

$$R^1(R^2NSO_2NR^4R^5)_n \quad (IV)$$

and wherein $R^1$, $R^2$, $R^3$, $R^4$, $R^5$ and n are as previously defined.

12. A composition according to claim 1 wherein said composition is water based, said lubricant base material is water soluble, said reaction product is water soluble, said amine of the formula (I) contains from 1 to about 7 carbon atoms, and $R^4$ and $R^5$ are hydrogen.

13. A composition according to claim 12 wherein $R^1$ is hydroxyalkyl, $R^2$ and $R^3$ are hydrogen and n=1.

14. A composition according to claim 1 wherein said composition is oil base, said lubricant base material is an oil of lubricating viscosity, said reaction product is oil soluble and said amine of the formula (I) contains from about 8 to about 30 carbon atoms.

15. A composition according to claim 14 wherein said amine (I) is a tertiary alkyl primary amine; $R^1$ is a tertiary alkyl radical containing from about 10 to about 24 carbon atoms; the nitrogen atom of the amine (I) is linked to a tertiary carbon atom; $R^2$, $R^3$, $R^4$ and $R^5$ are hydrogen and n=1.

16. A method for lubricating a metal surface which comprises applying to said metal surface a composition according to claim 1.

17. A method according to claim 16, wherein said composition is water soluble.

18. A method according to claim 16, wherein said composition is oil soluble.

19. A lubricating composition comprising:

(a) a lubricant base material; and (b) a reaction product of (1) an amine of the formula (I)

$$R^1(NR^2R^3)_n \quad (I)$$

wherein:

$R^1$ is a hydrocarbyl group containing from 1 to about 30 carbon atoms and having the valence n;

$R^2$ and $R^3$ are independently selected from the group consisting of hydrogen and a monovalent hydrocarbyl group; and n is a small positive integer, from 1 to about 6 and (2) a sulfamic compound, wherein said sulfamic compound is a compound of the formula (II)

$$HOSO_2NR^4R^5 \quad (II)$$

wherein:

$R^4$ and $R^5$ are independently selected from the group consisting of hydrogen and a monovalent hydrocarbyl group containing from 1 to about 30 carbon atoms atoms, at least one of $R^4$ or $R^5$ being hydrogen; said reaction product being present in a concentration of from about 0.2 to about 10 percent by weight.

20. A composition according to claim 1, wherein said sulfamic compound is sulfamic acid, and said amine is monoethanolamine or a tertiary alkyl primary amine containing from about 10 to about 24 carbon atoms.

* * * * *